United States Patent [19]

Riefler

[11] Patent Number: 4,584,043

[45] Date of Patent: Apr. 22, 1986

[54] INSULATED CONCRETE BLOCK ASSEMBLY AND METHOD OF MAKING THE SAME

[76] Inventor: Monte Riefler, P.O. Box 210, Hamburg, N.Y. 14075

[21] Appl. No.: 523,288

[22] Filed: Aug. 15, 1983

[51] Int. Cl.[4] ..... E04G 21/00

[52] U.S. Cl. ..... 156/297; 52/309.5; 52/404; 52/570; 52/747

[58] Field of Search ..... 52/309.11, 309.12, 379, 52/405, 407, 426, 427, 569, 570, 571, 572, 698, 699, 701, 309.5, 404, 89, 309.2–309.4, 747; 156/297

[56] References Cited

U.S. PATENT DOCUMENTS

| | | | |
|---|---|---|---|
| 1,620,834 | 3/1927 | Rhodes | 52/426 |
| 2,213,355 | 9/1940 | Woodworth | 52/405 |
| 2,669,861 | 2/1954 | Clutter | 52/426 |
| 3,868,801 | 3/1975 | Weinar | 52/309.5 |
| 4,229,920 | 10/1980 | Lount | 52/426 |
| 4,312,164 | 1/1982 | Walt et al. | 52/405 |
| 4,321,779 | 3/1982 | Kratchmer | 52/426 |

FOREIGN PATENT DOCUMENTS

| | | | |
|---|---|---|---|
| 69116 | 1/1983 | European Pat. Off. | 52/404 |
| 2250590 | 4/1974 | Fed. Rep. of Germany | 156/297 |
| 2308750 | 12/1976 | France | 52/612 |
| 2405625 | 6/1979 | France | 52/309.3 |
| 2418311 | 10/1979 | France | 52/405 |
| 55-9972 | 1/1980 | Japan | 52/309.12 |
| 572141 | 1/1976 | Sweden | 52/596 |

*Primary Examiner*—John E. Murtagh
*Assistant Examiner*—Andrew Joseph Rudy
*Attorney, Agent, or Firm*—Ralph Hammar

[57] ABSTRACT

An insulated concrete block assembly which can be laid dry or with mortar joints. The assembly has a pair of standard concrete blocks adhesively bonded to opposite sides of a panel of insulating material and a flat sheet metal tie bridging the panel and having opposite ends adhesively bonded to load carrying surfaces of the blocks. The adhesive bond is stronger than the concrete, so that once made up, the assembly cannot be taken apart without breaking the concrete.

4 Claims, 6 Drawing Figures

INSULATED CONCRETE BLOCK ASSEMBLY AND METHOD OF MAKING THE SAME

This invention is an insulated concrete block assembly which is laid as a unit.

Figure 1:
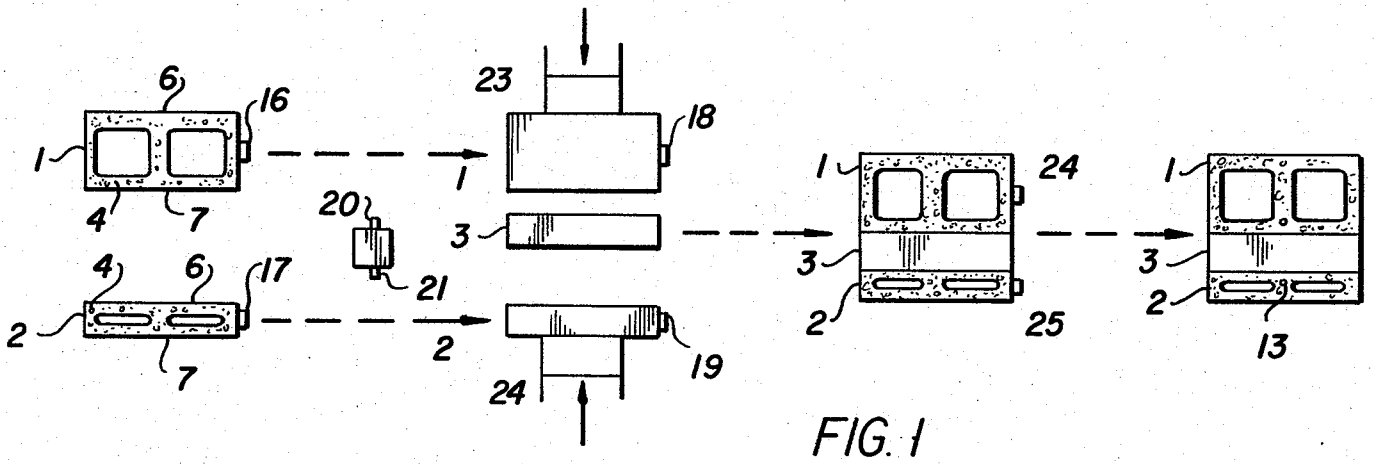
Figure 6:
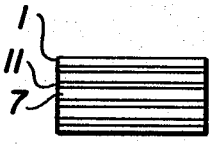
Figure 2:
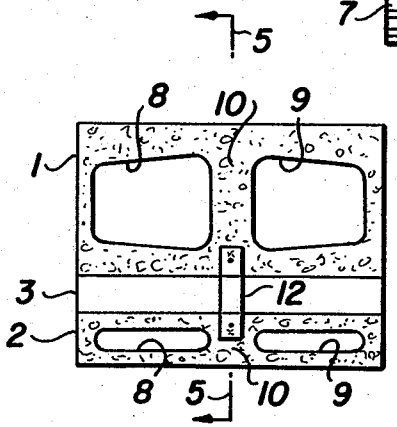
Figure 3:
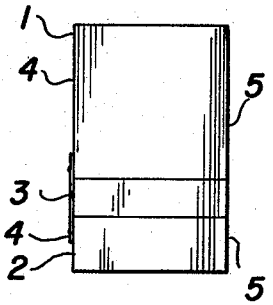
Figure 4:
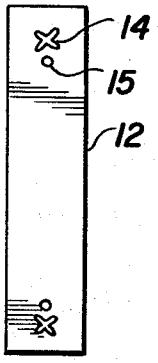
Figure 5:
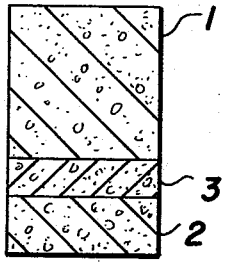

In the drawing, FIG. 1 is a diagram of the method of assembling the blocks, FIG. 2 is a plan view of a block, FIG. 3 is an end view of FIG. 2, FIG. 4 is a plan view of the sheet metal tie, FIG. 5 is a section on line 5—5 of FIG. 2, and FIG. 6 is a view of the adhesive coatings on one of the blocks.

The assembly comprises concrete blocks 1 and 2 on opposite sides of a panel 3 of suitable insulating material such as polystrene foam. The concrete blocks are standard blocks such as made on block machines. The blocks 1, which are thicker than the blocks 2, are intended to be the primary load carrying blocks and to constitute the inner surface of a building wall. The blocks 2, which are thinner than the blocks 1, are intended to provide an exterior facing for the wall. Both of the blocks have horizontal top and bottom load carrying surfaces 4 and 5 between which extend vertical inner and outer surfaces 6 and 7. Each of the blocks also has cored out vertical openings 8 and 9 on opposite sides of a crossweb 10 extending between the top and bottom surfaces 4 and 5. Opposite ends of the crossweb 10 are integral with the inner and outer faces of the block. To secure the blocks in assembled relation, the side 7 of the block 1 and the side 6 of the block 2 are each coated with horizontal stripes 11 of hot melt adhesive, as shown in FIG. 6. The blocks are then pushed together against opposite sides of the panel 3 of insulating material. The hot melt adhesive is strong enough so that the blocks cannot be disassembled from the insulation panel without breaking the concrete during handling by the mason when laying the cavity type block wall.

To further aid in holding the blocks in assembled relation, a sheet metal strip 12 has opposite ends cemented to the crosswebs 10 of the blocks 1 and 2. This is accomplished by placing a spot 13 of hot melt adhesive on each of the crosswebs 10, as shown in FIG. 1. The ends of the tie strip 12 are pressed onto the spots 13 of hot melt adhesive. Some of the adhesive interlocks with indentations 14 in the tie strip and some of the adhesive extrudes through holes 15 in the strip forming buttons which mechanically interlock the strip with the adhesive. The sheet metal strip 12 is very thin (26 gauge) so that the thickness of the strip does not interfere with dry stacking of the blocks. When used with conventional mortar joints, the tie strip 12 is embedded in the mortar joints. The joint between the adhesive and the tie strip 12 is stronger than the concrete so that the blocks are positively tied together.

The complete assembly can be handled as a single unit whether the wall is laid with mortar joints or with dry stacking. In either case, the inner and outer blocks of the wall are tied together under controlled factory conditions so that the skill of the mechanic laying the blocks is not involved. Since each layer of blocks is positively tied together, the ties greatly exceed code requirements.

In FIG. 1 is diagrammatically shown a method of making the block assemblies. The blocks 1 and 2 are fed from conveyors which feed the blocks end to end against retractable stops 16, 17 which positively stop the leading blocks with leading ends in alignment, as shown in FIG. 1. Upon retracting the stops 16, 17, the leading blocks move to the right, as viewed in FIG. 1, until the blocks are stopped by retractable stops 18, 19. While moving to the second position, with the blocks stopped against stops 18, 19, the blocks move past two sets of vertically spaced guns 20, 21 for respectively applying the horizontal stripes 11 of adhesive to the blocks 1 and 2. The number of stripes of adhesive is not critical. Four stripes, as shown in FIG. 6, are suitable for blocks eight inches thick, one of the standard sizes. Upon reaching the second position, where the blocks are stopped against stops 18 and 19, a panel 3 of insulating material such as polystyrene foam is dropped in place between the blocks and plungers 22 and 23 are actuated to push the blocks against opposite sides of the insulating panel. The hot melt adhesive applied by the guns 20, 21 sets up quickly so that the blocks 1 and 2 are securely fastened together. Upon retracting the stops 18, 19, the assembly moves to its final position against retractable stops 24, 25 and guns apply spots 13 of hot melt adhesive to the crosswebs 10 of the blocks. The ends of the sheet metal tie are now pressed downward against the spots 13, anchoring the ends of the ties to the crosswebs of the blocks. Upon release of the stops 24 and 25, the assembly continues on the conveyor to a delivery point.

The terms upper, lower and inner, outer are not terms of limitation, but are terms used to describe the particular structure illustrated.

I claim:

1. A method of making an insulated concrete block assembly which can be laid as a unit dry or with mortar joints between adjacent assembles, said assembly consisting essentially of:

an inner concrete block having upper and lower load bearing surfaces and inner and outer faces extending between said upper and lower surfaces and a central crossweb extending between said upper and lower surfaces and having ends integral with said inner and outer faces, an outer concrete block spaced from and registering with said inner block and having upper and lower load bearing surfaces and inner and outer faces extending between said upper and lower surfaces and a central crossweb extending between said upper and lower surfaces and having ends integral with said inner and outer faces, a board of insulating material sandwiched between and adhesively bonded to the outer face of said inner block and to the inner face of said outer block, said board having an upper edge registering with the upper surfaces of said blocks, a sheet metal tie having opposite ends respectively lying flat on and bridging said upper edge of said insulating material and adhesively bonded to the upper surfaces of the crosswebs of said inner and outer blocks, the adhesive bonds to the blocks being of greater strength than the concrete;

said method consists of conveying said inner and outer blocks along laterally separted paths to stops, positioning a set of one inner and one outer block with the outer face of the inner block presented to and in register with, but laterally spaced from the inner face of the outer block, conveying said set of blocks past two sets of adhesive guns, one set facing and applying adhesive to said outer face of the inner block and the other set facing and applying adhesive to said inner face of the outer block, stopping said inner and outer blocks in register with and laterally spaced from each other with said adhesive coated faces facing each other, inserting a board of insulating material between and registering with said adhesive coated faces, pressing the blocks together to compress the board between the adhesive coated faces of said blocks, applying a spot of adhesive to the upper surface of the crossweb of each block, and pressing the ends of the sheet metal tie against said spots to adhesively bond the tie to said blocks.

2. An insulated concrete block assembly which can be laid as a unit dry or with mortar joints between adjacent assemblies, said assembly consisting essentially of:

an inner concrete block having upper and lower load bearing surfaces and inner and outer faces extending between said upper and lower surfaces and a central crossweb extending between said upper and lower surfaces and having ends integral with said inner and outer faces, an outer concrete block spaced from and registering with said inner block and having upper and lower load bearing surfaces and inner and outer faces extending between said upper and lower surfaces and a central crossweb extending between said upper and lower surfaces and having ends integral with said inner and outer faces, a board of insulating material sandwiched between and adhesively bonded to the outer face of said inner block and to the inner face of said outer block, said board having an upper edge registering with the upper surfaces of said blocks, a sheet metal tie having opposite ends respectively lying flat on and bridging said upper edge of said insulating material and adhesively bonded to the upper surfaces of the crosswebs of said inner and outer blocks, by spots of adhesive applied to the crosswebs onto which the ends of the tie are pressed, the adhesive bonds being of greater strength than the concrete.

3. The structure of claim 2 in which the ends of the tie have indentations interlocking with the spots of adhesive.

4. The structure of claim 2 in which the tie has holes through which adhesive from the spots extrudes to form buttons mechanically interlocking the tie with the adhesive.

* * * * *